United States Patent [19]

Rynard

[11] 4,208,570

[45] Jun. 17, 1980

[54] THERMOSTATICALLY CONTROLLED ELECTRIC ENGINE COOLANT HEATER

[75] Inventor: Richard H. J. Rynard, Toronto, Canada

[73] Assignee: Canadian General Electric Company Limited, Toronto, Canada

[21] Appl. No.: 939,668

[22] Filed: Sep. 5, 1978

[30] Foreign Application Priority Data

Sep. 15, 1977 [CA] Canada ..... 286863

[51] Int. Cl.[2] ..... F02N 17/04; F24H 1/10; H05B 1/02; H05B 3/82

[52] U.S. Cl. ..... 219/208; 123/142.5 E; 219/306; 219/322; 219/328; 337/380

[58] Field of Search ..... 219/205, 208, 328, 331, 219/322, 306, 316; 123/142.5 R, 142.5 E; 337/380

[56] References Cited

U.S. PATENT DOCUMENTS

| | | | |
|---|---|---|---|
| 2,266,216 | 12/1941 | Kimberlin | 219/208 X |
| 2,574,929 | 11/1951 | McClain | 219/208 X |
| 2,802,921 | 8/1957 | Miklas | 219/316 |
| 3,104,306 | 9/1963 | Markley | 219/306 X |
| 3,276,599 | 10/1966 | Them | 219/328 X |
| 3,626,148 | 12/1971 | Woytowich et al. | 219/208 |
| 3,715,567 | 2/1973 | Mandziak | 219/328 X |
| 3,883,717 | 5/1975 | Del Percio | 337/380 X |
| 4,041,433 | 8/1977 | Watson | 219/328 X |

FOREIGN PATENT DOCUMENTS

| | | | |
|---|---|---|---|
| 1145994 | 3/1969 | United Kingdom | 219/331 |

*Primary Examiner*—A. Bartis

*Attorney, Agent, or Firm*—Raymond A. Eckersley

[57] ABSTRACT

An automobile engine coolant heater for connection to hoses of the engine coolant systems has a elongated cylindrical jacket portion defining a coolant flow path from an inlet at one end to an outlet at the other end. A metal sheathed heating element is located within the flow path and includes elongated heat generating leg portions. A thermostat for regulating operation of the heating element is mounted in heat conductive relationship on a flattened exterior portion of the jacket. An elongated, open ended metallic heat transfer tube provides a thermal bridge between the heating element leg portions and the interior surface of the flattened portion of the jacket. The heat transfer tube and heating element legs are in axial alignment with the longitudinal axis of the jacket to minimize flow resistance through the flow path. The heat transfer tube is brazed to the leg portions and to the flattened portion. When operated without the heating element being immersed, the heat transfer tube dissipates heat from the heating element so as to prevent element burnout, reduces the time lag before cut-out temperature is reached by the thermostat and renders the thermostat much less susceptible to variations in ambient temperature.

8 Claims, 4 Drawing Figures

THERMOSTATICALLY CONTROLLED ELECTRIC ENGINE COOLANT HEATER

This invention relates to improvements in electric automotive engine heaters. It particularly relates to heaters of the "flow through" type that are coupled to rubber hoses in the engine coolant system.

In heaters of the above type excessive temperatures can be reached when the heater is operated without the heating element being properly immersed in engine coolant. This can quickly lead to the destruction of the element, the electrical cord set or the hoses connecting the heater to the engine cooling system.

Various proposals have been made for the incorporation of temperature sensing cut outs, either in the form of a thermal fuse or as a thermostat. Generally the temperature sensing area is in the terminal area of the heating element i.e. where the heating element passes through the jacket wall of the heating device. Reliance is placed upon the conduction of heat along the sheath of the heating element to this area. When the heating element is operated without being immersed there is an appreciable time lag before the cut out temperature is reached by the sensor, as the rate of heat transference is comparatively low. More importantly the time lag is significantly dependent upon ambient temperature. Thus the cut out temperature may be reached comparatively quickly at an ambient of 10° C. or more, but it is reached much more slowly at ambients of −20° C. or less which may commonly be experienced. Even under favorable conditions the tip temperature of a hairpin type heating element may reach 600°–700° C. before cut out occurs. Under less favorable conditions burn out temperatures may be rapidly exceeded.

Desirably and for maximum effective control, the temperature of the surface of the heating element should be sensed. This would necessitate some type of seal where the sensing element, or an electrical connection thereto, passes through the jacket wall of the heater. Additionally it would provide an undesirable restriction for coolant flow through the heater.

According to the present invention, there is provided an automotive flow through heater having improved thermal conductivity between the electrical heating element and a thermal sensing unit situated externally of the heater jacket. Embodiments constructed in accordance with my invention may be made to be much less susceptible to variations in ambient temperature, in comparison to those of the prior art wherein thermal flow through the sheath of the heating element is predominately relied upon.

Also, in a specific aspect of my invention, the temperature of the sheath of the heating element under steady state, non-immersed heating conditions may be significantly reduced, thereby decreasing the possibility of element burn out under abnormal operating conditions.

In a still further aspect of my invention, the thermal conductivity between the electrical heating element and the thermal sensing unit may be readily varied in a predetermined manner.

These above benefits may be realized without significantly impeding coolant flow through the heater during normal operation and without necessitating connections passing through the jacket.

In its broadest aspect my invention comprises a flow through type automotive heater wherein a metal sheathed resistance heating element is linked by a thermal bridge to a preselected portion of the interior surface of the jacket of the heater. The thermal bridge comprises a pair of elongated arms which are parallel to each other and to the longitudinal axis of the cylinder, so as to minimize flow resistance. Preferably the arms form part of an open-ended tube. A thermally activated switch serially connected with the heating element is located in heat transfer relationship with the external surface of the jacket in the predetermined area.

My invention will be further described with reference to a preferred embodiment thereof, as illustrated in the accompanying drawings wherein FIG. 1 is a perspective, partially broken away view of a hose type flow through heater constructed in accordance with my invention.

Figure 1:
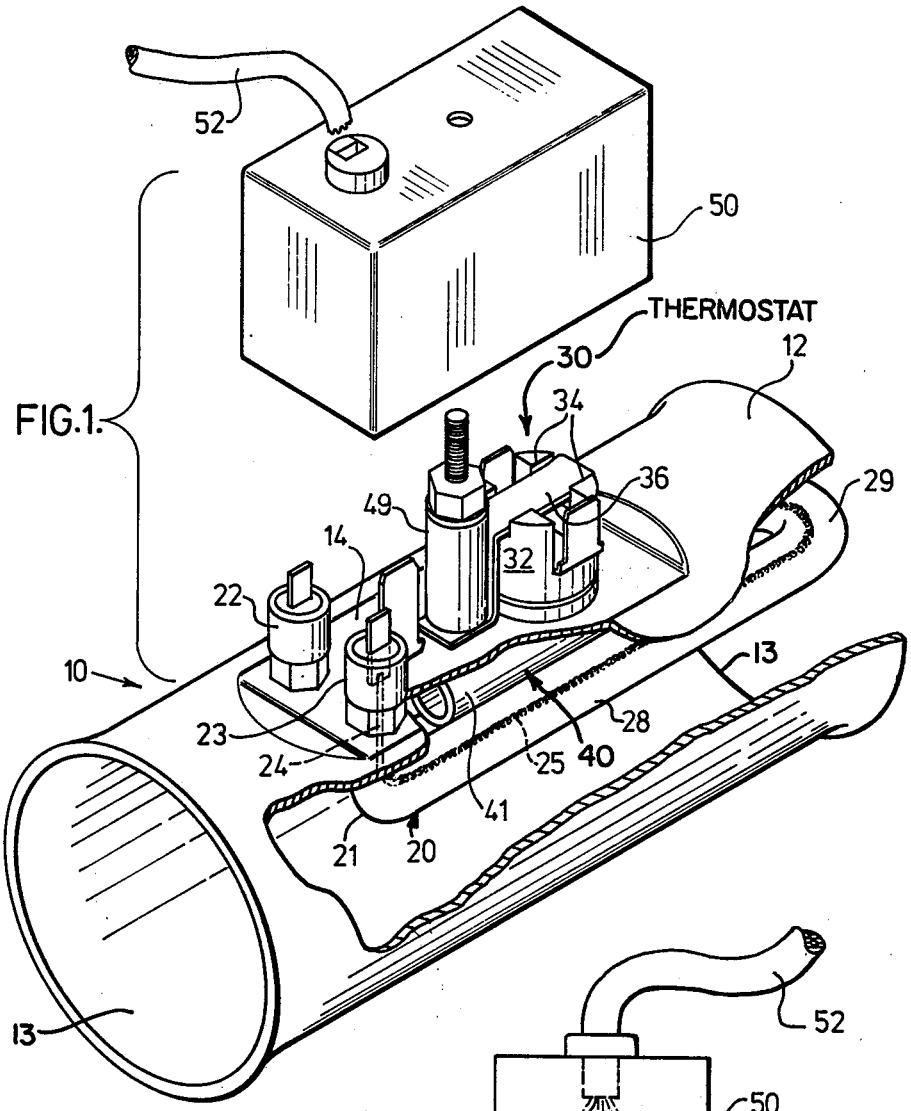
Figure 4:
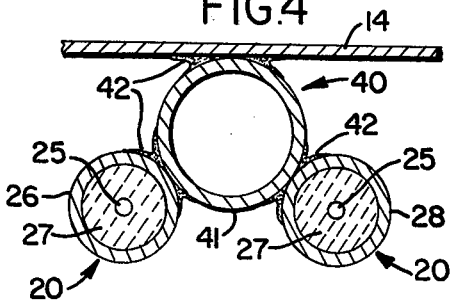
FIG. 4 is a partial transverse section of the heater of FIG. 1 on an enlarged scale showing detail of the thermal bridge.
Figure 2:
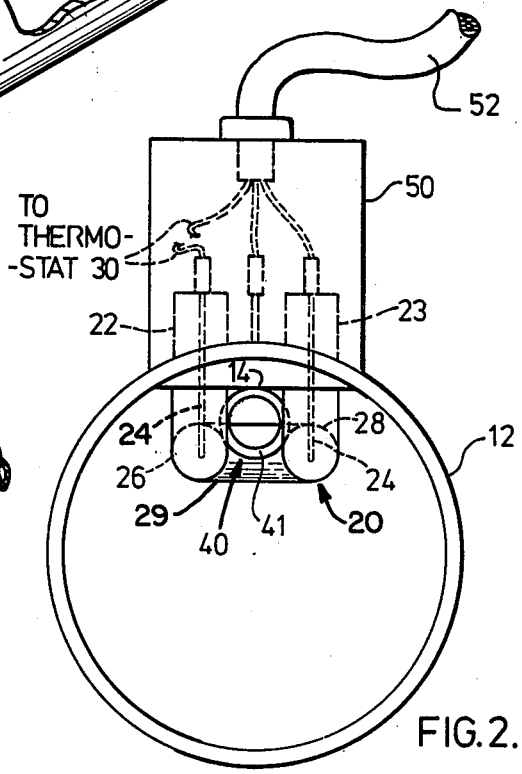
FIG. 2 is an end elevation of the structure of FIG. 1.

Referring to FIGS. 1 & 2 in detail, a hose type automotive heater is represented by the numeral 10. Heater 10 comprises a generally cylindrical jacket 12 having longitudinally elongated, flattened portion 14. Jacket 12 has an opening 13 at each end thereof to define a flow path therethrough. A hairpin form metal sheathed electrical resistance heating element 20 has a sheath 21, terminal ends 22, 23 cranked upwardly, these ends passing through jacket 21 in the flattened portion 14 and being sealed thereto. Heating element 20 has two generally parallel, axially aligned legs 26, 28 connected by a bight 29. Legs 26, 28 lie in a plane generally parallel to the plane of flattened portion 14 of the jacket, and are spaced therefrom so as to lay in the flow path. The internal structure of heating element 21 is shown in FIG. 1 in faint outline on one side thereof, and in FIG. 4, and commonly comprises a terminal 24 of relatively low electrical resistance which projects within the end of sheath 21 for some 2.5 to 4 cms. i.e. adjacent the cranked area, and a resistance heating spiral 25 connecting to the interior end of terminal 24 embedded in a refractory insulating material 27. Thermal energy is generated almost exclusively in the leg portions 26, 28 and connecting bight 29 of heater 20. There is substantially no generation of thermal energy in terminal ends 22, 23 of heater 20. Manufacturing methods and economic considerations dictate the choice of materials of construction; terminal 24 and sheath 21 are both ferrous base metals. It will be appreciated that the thermal conductive path from the heat generating portions of heater 20 to the terminal ends 22, 23 thereof is relatively poor, and that high thermal differentials will exist therebetween when the heater is operated in air.

A bimetal thermostat or other switching device 30 is located on the exterior surface of flattened portion 14 of jacket 12, and is symmetrically placed with respect to legs 26, 28 of heating element 20. Thermostat 30 is biased into heat exchange relationship with jacket 12 by a leaf spring 36. Spring 36 is formed into a generally rectangular S shaped bracket. One horizontal arm of spring 36 is firmly secured to jacket 12 by screw assembly 49, which is itself welded or brazed to the jacket. The other horizontal arm of spring 36 is received in an axial groove 34 formed in the upper surface of an insulative housing 32 of thermostat 30, thus providing a lateral location for the thermostat. This other horizontal arm is downwardly turned at its distal end (not seen in illustration), the spacing between the downwardly turned end and the vertical arm of the S shaped spring being such as to closely receive the insulative housing 32 therebetween, so as to locate the thermostat in an axial direction.

A thermal bridge 40 which links portions of heater 20 intermediate the ends thereof to the interior surface of jacket 12 beneath thermal switch 30 is formed by an open-ended axially elongated metal tube 41. Tube 41 may have an incomplete annular section eg. an inverted U section. What is desired is to provide a thermal flow path between each leg of the heating element 20 and jacket 12 respectively without unduly restricting coolant flow through heater 10. It is preferred that the thermal bridge 40 be secured to heater 20 and jacket 12 by brazing material 42 so as to provide an intimate thermal contact between these various members. Construction is facilitated when thermal bridge 40 is of circular section as illustrated, since this may be merely supported on legs 26, 28 of heater 20 during the assembly and brazing operations, without being specially oriented and mechanically affixed to ensure the requisite thermal flow paths. Thermal bridge 40 will normally be constructed from a metal having a good thermal conductivity such as copper or brass, although ferrous base materials may less desirably be used.

Figure 3:
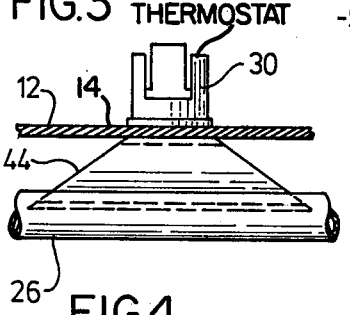
FIG. 3 is a side elevation partly in section, of a second embodiment showing detail of a heat transfer member.

The transference of thermal energy from heating element 20 to jacket 12 under abnormal operating conditions may be readily varied in a predetermined manner by varying the surface area of thermal bridge 40 in contact with the legs 26, 28 of heater 20 and with jacket 12 respectively. As shown in FIG. 3, the ends of a tube 44 are cut on a bias so that the axial length of tube 44 in contact with jacket 12 approximates the axial length of the predetermined area 14 of jacket 12 with which thermal switch 30 is in contact, whilst the axial length of tube 44 in contact with legs 26, 28 of heating element 20 is somewhat greater. Whilst this embodiment may be preferred in some circumstances, tube 44 would require orienting prior to assembly to achieve the desired thermal relationship of the parts. In general, and as shown in FIGS. 1 and 2, tube 41 is cut on a right circular section and extends on each axial side of the predetermined area of jacket 12 on which switch 30 is located. This arrangement is less critical as regards assembly, and also improves the heat dissipation from heater 20 during non-immersed operation whereby heater burn out temperatures will not be attained.

Heater 10 further includes an insulative, box like cover 50 having a plan form approximating that of flattened jacket portion 14. Electrical supply cord 52 provides electrical energy to heater 10. The electrical connections are omitted for the sake of clarity; one line of cord 52 connects directly to one terminal, say 24, of heating element 20, whilst the other line of cord 52 connects serially through switch 30 and thence to the other heater terminal.

Under test a heater 10 constructed in accordance with my invention having a nominally 800 watt heating element 20 with a thermal output of approximately 20 watts per square centimeter was energized without coolant at an ambient of 25° C. Thermostat 30 was chosen to open at 99° C. The temperature of heating element 20 in the tip area (bight 29), which normally operates above the temperature of remaining portions of the heating element, did not exceed about 600° C. prior to the first operations of switch 30, and there-after decreased to about 400° C. under steady state conditions. Only minor portions of the exterior surface of jacket 12 exceeded the nominal temperature of operation of thermostat 30. When energized without coolant under an ambient of −20° C. the temperature of heating element 20 did not differ appreciably from the above.

In comparison a flow through type heater of the prior art having similar characteristics to those above, but relying on heat conduction through the sheath of the heating element to activate a thermostat located on the exterior surface of the jacket adjacent terminal ends 22, 23 reached a tip temperature of about 850° C. on the first cycle, which reduced to about 720° C. under steady state conditions, when it was energized at an ambient of 20° C. without coolant. Appreciable areas of the jacket surface were raised to temperatures considerably above the nominal operating temperature of the thermostat due to radiant heat transfer from the heating element.

Comparison of the heaters when operated under ambients of −20° C. and less shows the disparity between the nominal thermostat temperature and the temperatures experienced by the sheath of the heating elements to be increased in both instances, but by a larger factor in the case of the prior art arrangement than for the heater 10 constructed in accordance with the foregoing principles.

What I claim as new and desire to secure by Letters Patent of the United States is:

1. In an automotive heater including a jacket having a cylindrical portion with an inlet at one end and an outlet at the other end thereof to define a fluid flow path therethrough, a metal sheathed electrical resistance heating element, said heating element being supported from said jacket with terminal portions on the exterior side thereof and heat generating leg portions on the interior side thereof and spaced therefrom, said leg portions being in the fluid flow path and generally aligned with the longitudinal axis of said cylindrical portion, the improvement which comprises providing in series electrical connection with said heating element a thermal switching means in heat transfer relationship with a predetermined area on the outer surface of said jacket, and providing a thermal bridge separate from said metal sheath linking said heat generating leg portions of said heating element and the interior surface of said jacket in said predetermined area, said thermal bridge comprising a pair of elongated arms, said arms being parallel to each other and aligned with the longitudinal axis of said cylindrical portion and said heating element legs so as to be parallel to the direction of fluid flow, and being in contact with said heating element legs and with the interior of said jacket in said predetermined area.

2. The heater of claim 1 wherein the axial length of said arms decreases with approach to said predetermined area.

3. The heater of claim 1 wherein said thermal bridge is secured to said legs and said predetermined area by brazing material.

4. The heater of claim 3 wherein said arms comprise portions of an open-ended tube.

5. The heater of claim 4 wherein said arms contact said interior surface on each longitudinal axial side of said predetermined area.

6. The heater of claim 3 wherein said cylindrical portion includes a flattened, longitudinally elongated portion wherein said predetermined area locates, and wherein said legs are contained in a plane generally parallel to the flattened portion of said jacket.

7. The heater of claim 6 wherein said thermal switching means is spring biased into contact with said predetermined area.

8. The heater of claim 7 wherein said spring comprises a resilient bracket secured to the exterior surface of said jacket so as to provide an axial and lateral locating means for said thermal switching means.

* * * * *